United States Patent [19]

Itoh et al.

[11] Patent Number: 4,553,636

[45] Date of Patent: Nov. 19, 1985

[54] LIFESAVING APPARATUS FOR ESCAPING FROM A BUILDING

[76] Inventors: Hideo Itoh, 10 27-chome, Kita 7 Jo Nishi Chuo-ku Sapporo City Hokkaido; Hideki Itoh, 21 11-Chome, Kita 23 Jo Nishi Kita-ku Sapporo City Hokkaido; Hideya Itoh, 10 27-Chome Kita 7 Jo Nishi, Chuo-ku Sapporo City Hokkaido, all of Japan

[21] Appl. No.: 596,351

[22] Filed: Apr. 3, 1984

[30] Foreign Application Priority Data

Apr. 25, 1983 [JP] Japan ..... 58-61870

[51] Int. Cl.[4] ..... A62B 1/02

[52] U.S. Cl. ..... 182/231; 182/73; 182/142

[58] Field of Search ..... 182/3, 142, 42, 43, 182/73, 100, 231

[56] References Cited

U.S. PATENT DOCUMENTS

| | | | |
|---|---|---|---|
| 95,321 | 9/1869 | Carrigan | 182/3 |
| 157,912 | 12/1874 | Gathright | 182/3 |
| 275,514 | 4/1883 | Pappa | 182/142 |
| 323,092 | 7/1885 | Werner | 182/142 |
| 356,436 | 1/1887 | Anderson | 182/43 |
| 487,395 | 12/1892 | Mannheim | 182/142 |
| 748,114 | 12/1903 | Smith | 182/43 |
| 816,495 | 3/1906 | Moore | 182/3 |

FOREIGN PATENT DOCUMENTS

| | | | |
|---|---|---|---|
| 599349 | 3/1948 | United Kingdom | 182/196 |

*Primary Examiner*—Reinaldo P. Machado
*Attorney, Agent, or Firm*—Watson, Cole, Grindle & Watson

[57] ABSTRACT

A lifesaving apparatus which enables quick escape from the upper floors of a tall building during emergencies includes a hoist device positionable on the building above the floors from which escape is to be provided, a fire-resistant rope element connected to the hoist device which can be raised and lowered with respect to the ground, the rope element including at least one attachment element along its length, and at least one container device for supporting a human being removably attachable to an attachment element of the rope, each container device including a closable entry opening.

10 Claims, 7 Drawing Figures

LIFESAVING APPARATUS FOR ESCAPING FROM A BUILDING

BACKGROUND OF THE INVENTION

1. Field of the Invention

The present invention relates to a lifesaving apparatus, and more particularly to a lifesaving apparatus which facilitates quick escape from a tall building in emergency situations, e.g., when the building is on fire or is in danger of collapse.

2. The Prior Art

Although modern buildings are constructed so as to be strong and to include extensive fire-prevention systems, and although older buildings such as office buildings and hotels have in many cases been renovated to meet modern building codes (which dictate measures to be taken to help prevent life-threatening situations from occurring), the fact is that fires nevertheless occur in both new and older buildings. Indeed, no building is immune from a potential collapse as a result of an earthquake, a bombing, etc. And when such emergency situations occur the elevators in the building are often either inoperative or automatically disconnected from their power sources and thus of no value in escaping from the building's upper floors. At the same time, the stairwells in the building may be unsafe to use, or at least so jammed with people as to be unusable. It can thus happen that the only way of escape from a building may be outwardly from its windows.

Unfortunately, ladders which can be extended upwardly from fire trucks have a limited span capability (e.g., up to about 12 stories), and conventional escape chutes extending down the side of a building may not constitute a satisfactory escape means because so many people may simultaneously scramble to get in them that injuries occur and the chute itself can become completely blocked.

It is thus an object of the present invention to provide a reliable and effective lifesaving apparatus which will enable escape from the upper floors of a tall building during emergency situations.

SUMMARY OF THE INVENTION

According to the present invention the lifesaving apparatus includes a hoisting device which can be mounted on a building at a point above the floors thereof from which escape is to be provided, a fire-resistant rope connected to the hoisting device so as to be raised and lowered by the hoisting device with respect to the ground, the rope including at least one attachment means along its length, and at least one container device which is removably attached to an attachment means on the rope, the container device including a closable entry opening and being preferably large and strong enough to contain and support a human being. Because the rope which is used will be long enough to enable each container device attached thereto to be lowered to the ground in a controlled manner, people who have climbed through the windows of the building and into the container devices can be safely lowered to the ground by suitable operation of the hoist device.

A further understanding of the present invention will be achieved by a review of the attached drawings taken in conjunction with the following discussion.

DETAILED DESCRIPTION OF THE PREFERRED EMBODIMENT

Figure 1:
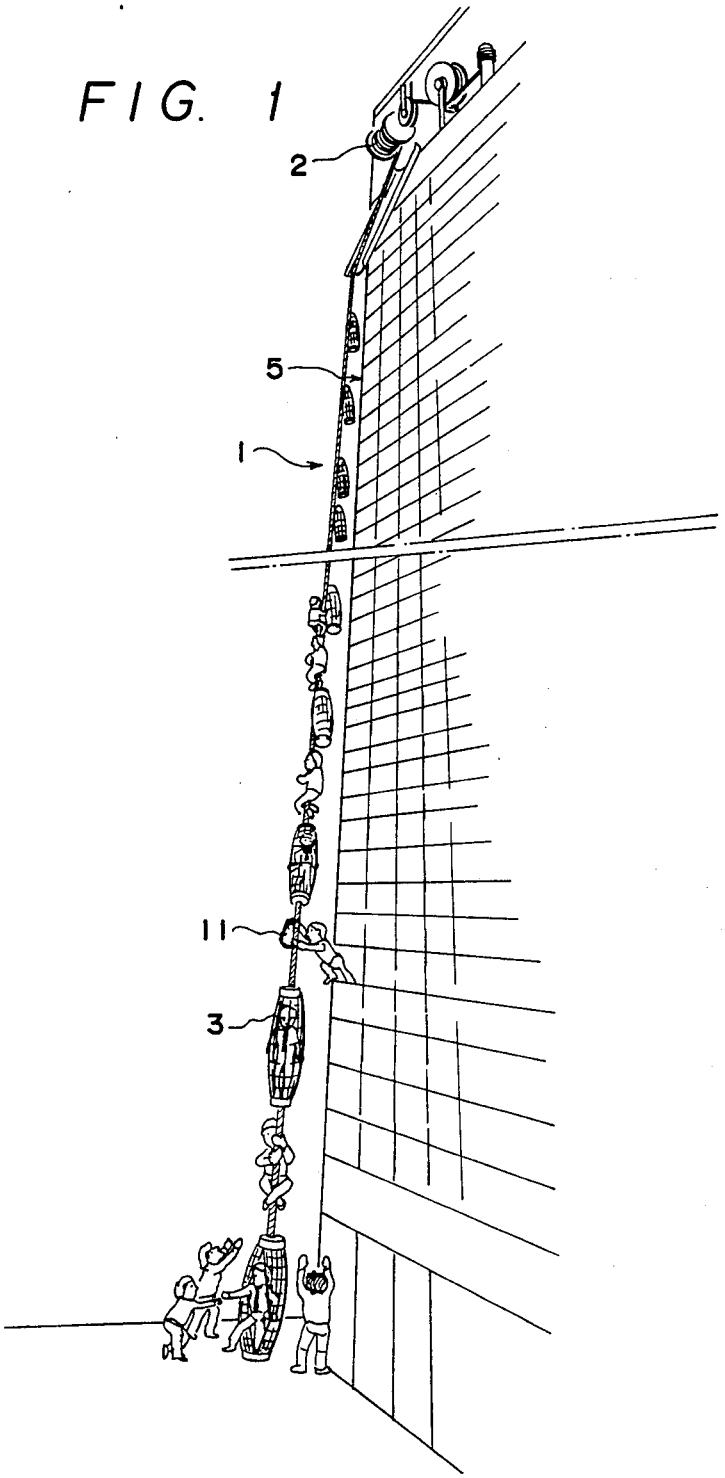
FIG. 1 shows one embodiment of a lifesaving apparatus according to the present invention when operatively attached to a building and when in use.

A lifesaving apparatus according to a preferred embodiment of the present invention is shown in FIG. 1 attached to a building 5 and in operational use. The apparatus includes a hoist device 2, which in this case is attached to support structures (not labeled) on the roof of the building, a rope element 1, and multiple container devices 3. The hoist device 2 is located reasonably near the side of the building from which escape is to be provided, and the rope element 1, which is attached to the hoist device 2, is shown hanging down almost vertically toward the ground. The container devices 3 are respectively attached to suitable attachment means (not shown) which are provided on the rope element at respective intervals along its length, e.g., at 2 to 3 meter intervals. Each container device 3 is sufficiently large and strong to house and support a human being.

Figure 4:
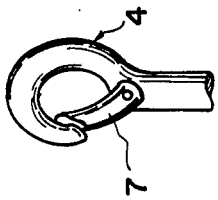
FIG. 4 shows, on the same scale as FIG. 2, a part of the hook on the container device.
Figure 3:
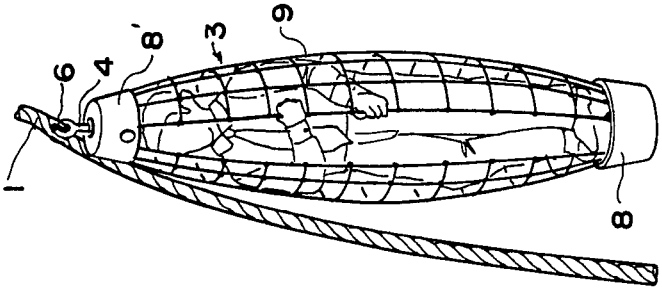
FIG. 3 shows, on a reduced scale as compared to FIG. 2, a container device of the inventive lifesaving apparatus which is connected to the rope element, the container device being shown containing a human being.
Figure 2:
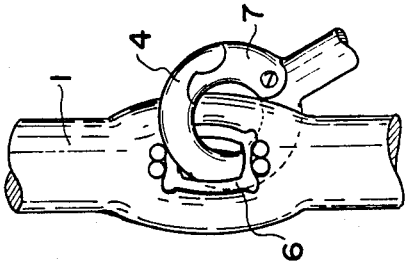
FIG. 2 shows an enlarged view of a portion of the rope element of the inventive lifesaving apparatus where it includes a ring attachment means, together with a cooperating portion of a hook which is attached to a container device of the inventive lifesaving apparatus.

Referring to FIG. 2, it can be seen that the attachment means on the rope element 1 are each in the form of a ring 6 contained wth the rope element, each ring 6 being sufficiently large to accept a hook 4 which is connected to the top of each container device (see FIG. 3). The connection of the hook 4 of each container device to a ring 6 is assured by a clasp 7. A slightly modified form of hook 4 is shown in FIG. 4.

Figure 6:
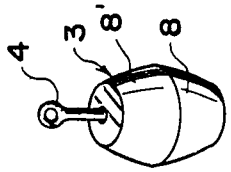
FIG. 6 shows, on the same scale as FIG. 3, the container device when collapsed into its storage condition.
Figure 5B:
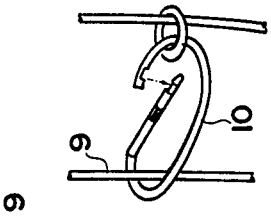
FIGS. 5*a* and 5*b* show, as the same scale as FIG. 4, a fastener used to close the container device shown in FIG. 3.
Figure 5A:
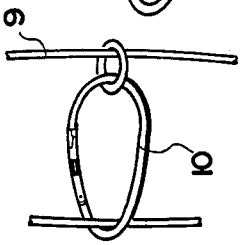

As seen in FIG. 3, the container device 3 includes an upwardly open, bowl-shaped bottom 8, a downwardly open, bowl-shaped top 8', a hook 4 attached to the top 8', and a wall means in the form of a net 9 connected between the bottom 8 and the top 8'. The net wall means 9 is in fact flexible such that the container device can be collapsed into the storage configuration shown in FIG. 6. The net wall means 9 provides a closable entry opening into the container device which can be closed by way of a loop fastener 10 (see FIGS. 5*a* and 5*b*).

Although not depicted in the drawings, the bowl-shaped bottom 8 can contain an impact-compensating means such as one or more springs so as to absorb shocks in the event the container device is abruptly deposited on the ground.

In operation, i.e., when the lifesaving apparatus is used to provide quick escape from a building, the hoist device 2 is operated to cause rope element 1 to descend along the side of the building (the rope element 1 can be normally stored in a shed on the roof), and people desiring to escape from the various floors of the building can (1) climb out a window of the building and enter a container device which has been previously attached to the rope element as the container device passes downwardly past their floor (a number of container devices can be previously attached to the lowermost attachment means on the rope element), or (2) climb out a window of the building and enter a container device which they themselves have just attached to an attachment means on the rope element, the container device having been stored in a collapsed condition inside the building near the window. The rope element is always long enough to enable every container device attached thereto to be lowered to the ground in a controlled manner by operation of the hoist device In a preferred embodiment of the invention the rope element can also include loop means 11 attached to ring attachment means 6 which will be sufficiently large to enable the leg of a person to be inserted therethrough, such that the person escaping from the building can be lowered to the ground without the need for a container device 3.

The rope element 1, the attachment ring means 11, and all the parts of the container device 3 must be made of fire-resistant materials. This is true of the loop means 11 as well. With respect to the rope element 1, which must be light in weight, flexible, durable and strong, it can be made of an aluminum alloy, processed aluminum, a synthetic resin or carbon fibers. The attachment ring means 4 can be made of metal. The loop means 11 can be made of metal or, most preferably, the same materials from which the rope element 1 is made.

Although a preferred embodiment of the invention has been shown and described, it is obvious that modifications thereto can be made and still fall within the scope of the appended claims.

We claim:

1. A lifesaving apparatus for providing quick escape from the upper floors of a tall building, said apparatus including a hoisting device positionable on the building at a point above the floors thereof from which escape is desired, a fire-resistant rope element connected to said hoisting device so as to be raised and lowered with respect to the ground by said hoist device, said rope element including at least one attachment means, and at least one container device which is removably attachable to an attachment means on said rope element, each container device including an upwardly open, bowl-shaped bottom, a downwardly open, bowl-shaped top, a hook device attached to said top, and a collapsible, fireproof wall means connected between said bottom and said top, said collapsible, fireproof wall providing a closable entry opening.

2. The lifesaving apparatus as defined in claim 1 wherein said rope element includes a plurality of attachment means located at respective intervals along its length.

3. The lifesaving apparatus as defined in claim 2 wherein each attachment means comprises a ring connected within said rope element.

4. The apparatus as defined in claim 3 wherein each ring is made of metal.

5. The lifesaving apparatus as claimed in claim 1 wherein said rope element is sufficiently long that each container device attached thereto can be lowered to the ground.

6. The lifesaving apparatus as defined in claim 1 wherein said collapsible, fireproof wall means comprises a fireproof net.

7. The lifesaving apparatus as defined in claim 1 wherein said rope element is made of an aluminum alloy.

8. The lifesaving apparatus as defined in claim 1 wherein said rope element is made of carbon fibers.

9. The lifesaving apparatus as defined in claim 1 wherein each container device is sufficiently large and strong to contain and support a human being.

10. The lifesaving apparatus as defined in claim 1 wherein said rope element includes loop means attached thereto, said loop means being capable of supporting a human being whose leg has been extended therethrough.

* * * * *